US006070396A

United States Patent [19]

Rinaldi et al.

[11] Patent Number: 6,070,396

[45] Date of Patent: Jun. 6, 2000

[54] CARTON FOLDING APPARATUS

[75] Inventors: Barry F. Rinaldi, Clarks Summit, Pa.; Edward Lefebre, Islip, N.Y.

[73] Assignee: Specialty Machinery, Inc., Dunmore, Pa.

[21] Appl. No.: 08/837,262

[22] Filed: Apr. 10, 1997

Related U.S. Application Data

[63] Continuation-in-part of application No. 08/757,894, Nov. 27, 1996.

[51] Int. Cl.[7] ..... B65B 7/20; B65B 59/02

[52] U.S. Cl. ..... 53/504; 53/69; 53/377.2; 53/491; 493/23

[58] Field of Search ..... 493/23, 25, 11, 493/10, 8; 53/504, 76, 75, 69, 67, 491, 377.2, 377.3, 376.4

[56] References Cited

U.S. PATENT DOCUMENTS

| | | | |
|---|---|---|---|
| Re. 29,442 | 10/1977 | Stolkin et al. | 93/49 |
| Re. 30,921 | 5/1982 | McDowell | 493/124 |
| 3,045,402 | 7/1962 | Keely et al. | 53/67 X |
| 3,053,153 | 9/1962 | Gilbert | 53/76 X |
| 3,884,130 | 5/1975 | Stolkin et al. | 93/49 |
| 3,913,464 | 10/1975 | Flaum | 93/36 |
| 3,913,465 | 10/1975 | Keck | 93/51 |
| 3,945,305 | 3/1976 | Barny | 93/49 |
| 3,964,374 | 6/1976 | Stolkin et al. | 93/36 |
| 3,992,982 | 11/1976 | Huiskes | 93/52 |
| 4,018,143 | 4/1977 | Dice, Jr. et al. | 93/36.3 |
| 4,024,693 | 5/1977 | Leasure et al. | 53/186 |
| 4,066,008 | 1/1978 | Arvanigian | 93/49 |
| 4,149,452 | 4/1979 | Talarico | 93/51 |
| 4,169,406 | 10/1979 | Tanham | 93/49 |
| 4,187,769 | 2/1980 | Bullock | 93/52 |
| 4,244,282 | 1/1981 | Ruzand et al. | 493/23 |
| 4,262,469 | 4/1981 | Ooms et al. | 53/491 |
| 4,273,548 | 6/1981 | Crane | 493/162 |
| 4,295,841 | 10/1981 | Ward, Jr. | 493/295 |
| 4,308,712 | 1/1982 | Hagedorn | 53/566 |
| 4,331,435 | 5/1982 | Nowacki | 493/178 |
| 4,331,436 | 5/1982 | Kuttenbaum et al. | 493/310 |

(List continued on next page.)

*Primary Examiner*—James F. Coan
*Attorney, Agent, or Firm*—Duane Morris & Heckscher LLP

[57] ABSTRACT

A carton folding apparatus operable to close the top of a carton having a front inner flap, a rear inner flap, a right outer flap, and a left outer flap. The carton folding apparatus comprises a frame which has an input end and an output end. Extending between the input end and the output end of the frame is a conveyor which is adapted to transport cartons from a position upstream of the input end of the frame to a position downstream of the output end thereof. A flap folding assembly is mounted for vertical movement along the frame in order to accommodate cartons of various sizes. The flap folding assembly is positioned above the conveyor and includes a stationary front flap folding bar, a rotatable rear flap folding arm, a right outer flap folding member, and a left outer flap folding member. Each of outer flap folding members includes an end. The ends of the outer flap folding members are adapted to be moved closer to or further from one another upon rotation of the outer flap folding members. The flap folding assembly can be adjusted to accommodate cartons of different sizes in response to information manually or automatically received by the apparatus.

14 Claims, 3 Drawing Sheets

U.S. PATENT DOCUMENTS

| | | | |
|---|---|---|---|
| 4,479,345 | 10/1984 | Nord | 53/564 |
| 4,531,931 | 7/1985 | Dietrich | 493/317 |
| 4,547,183 | 10/1985 | Mowry | 493/182 |
| 4,551,124 | 11/1985 | Mowry | 493/128 |
| 4,553,954 | 11/1985 | Sewell et al. | 493/309 |
| 4,563,169 | 1/1986 | Virta et al. | 493/96 |
| 4,579,551 | 4/1986 | Ulrich et al. | 493/23 |
| 4,585,432 | 4/1986 | Marysse | 493/59 |
| 4,604,083 | 8/1986 | Barny et al. | 493/34 |
| 4,608,038 | 8/1986 | Virta et al. | 493/29 |
| 4,614,511 | 9/1986 | Verhoef | 493/125 |
| 4,614,512 | 9/1986 | Capdeboscq | 493/441 |
| 4,629,446 | 12/1986 | Focke | 493/317 |
| 4,632,666 | 12/1986 | Ulrich et al. | 493/23 |
| 4,834,696 | 5/1989 | Marschke | 493/179 |
| 4,857,038 | 8/1989 | Tacchini | 493/316 |
| 4,861,325 | 8/1989 | DiMarzio | 493/124 |
| 4,892,513 | 1/1990 | Kwiek | 493/316 |
| 4,915,678 | 4/1990 | Morita | 493/116 |
| 4,922,687 | 5/1990 | Chow et al. | 53/504 X |
| 4,946,540 | 8/1990 | Mitchard | 156/556 |
| 4,988,330 | 1/1991 | Bensberg | 493/16 |
| 5,063,726 | 11/1991 | Boisseau | 53/491 |
| 5,092,827 | 3/1992 | McAdam, III et al. | 493/179 |
| 5,105,600 | 4/1992 | DePoint, Jr. et al. | 53/468 |
| 5,106,359 | 4/1992 | Lott | 493/125 |
| 5,112,288 | 5/1992 | Ulrich et al. | 493/27 |
| 5,114,392 | 5/1992 | McAdam, III et al. | 493/179 |
| 5,156,582 | 10/1992 | Thompson | 493/117 |
| 5,230,686 | 7/1993 | McAdam, III et al. | 493/23 |
| 5,290,224 | 3/1994 | Boix Jaen | 493/183 |
| 5,312,316 | 5/1994 | Wu | 493/123 |
| 5,323,586 | 6/1994 | Lissoni et al. | 53/377.2 X |
| 5,393,291 | 2/1995 | Wingerter | 493/116 |
| 5,454,776 | 10/1995 | Ulrich et al. | 493/117 |
| 5,480,371 | 1/1996 | Morita et al. | 493/117 |
| 5,507,907 | 4/1996 | Kropp et al. | 156/350 |
| 5,511,362 | 4/1996 | Morita et al. | 53/491 |
| 5,514,244 | 5/1996 | Krukas | 156/468 |
| 5,531,852 | 7/1996 | Walsh et al. | 156/227 |
| 5,536,231 | 7/1996 | Nilsson | 493/315 |

CARTON FOLDING APPARATUS

STATEMENT OF RELATED APPLICATIONS

This application is a continuation-in-part of application Ser. No. 08/757,894, filed on Nov. 27, 1996.

FIELD OF THE INVENTION

This invention relates to an apparatus and method for folding cartons and, more particularly, to an apparatus and procedure for efficiently and automatically folding the flaps of corrugated cartons of varying sizes in order to facilitate the subsequent sealing of the same.

BACKGROUND OF THE INVENTION

The packaging industry relies upon the efficient packing, folding and sealing of corrugated boxes, commonly referred to as cartons or cases. Automatic case sealing methods and equipment have been commercialized for decades. The top of a case typically includes a front inner flap, a back inner flap, and left and right outer flaps. Case sealing technology is designed to fold the outer box flaps over the inner flaps and seal them shut with adhesive tape. Some of the relatively older models of case sealing equipment are adapted to convey an open box, which is filled with product to be shipped, along a conveyor belt. As the box is moved along the belt of these existing case sealing devices, the front inner flap contacts a folding bar which causes it to fold inwardly. The back inner flap is folded by a hydraulic or pneumatic closing mechanism which swings around and folds the back inner flap. The left and right outer flaps are then folded over the inner flaps by a pair of lateral bars with a sloping downstream vortex which causes them to slowly fold downward into a closed position as they move along the belt. Finally, the facing edges of the left and right outer flaps are sealed with a single-sided adhesive tape. Since the lids of the boxes are folded as they are moved along the conveyor belt by sloping bars which have a continuously reducing opening, a significant amount of lead time prior to closure as well as a long length of processing equipment is required to accomplish the folding.

Such prior art apparatus traditionally are dedicated to packing a particular object or product into the same size carton at a relatively high rate of speed. In some of these machines, it is possible to shut down the apparatus and make manual adjustments to configure the machine for a different type of product or different size case. Such practices produce significant and costly downtime. Additionally, the folding bars or rails which apply force to the left and right outer flaps have been known to sometimes inaccurately fold or twist the flaps.

Accordingly, there is a need for a case sealing apparatus which is capable of folding the flaps on cartons of various sizes without interruption. There is also a need for a case sealing device which does not require lengthy pieces of heavy equipment.

SUMMARY OF THE INVENTION

In accordance with the illustrative embodiments, demonstrating features and advantages of the present invention, there is provided a carton folding apparatus operable to close the top of a carton having a front inner flap, a rear inner flap, a right outer flap, and a left outer flap. The carton folding apparatus comprises a frame which has an input end and an output end. Extending between the input end and the output end of the frame is a conveyor which is adapted to transport cartons from a position upstream of the input end of the frame to a position downstream of the output end thereof. A flap folding assembly is mounted for vertical movement along the frame in order to accommodate cartons of various sizes. The flap folding assembly is positioned above the conveyor and includes a stationary front flap folding bar, a rotatable rear flap folding arm, a right outer flap folding member, and a left outer flap folding member. Each of outer flap folding members includes an end. The ends of the flap folding members are adapted to be moved closer to or further from one another upon rotation of the outer flap folding members. The flap folding assembly can be adjusted to accommodate cartons of different sizes in response to information manually or automatically received by the apparatus.

Accordingly, the present invention provides an automatic or semiautomatic carton flap folding apparatus which is compact to maximize floor space. The apparatus can be custom designed to fit various packaging requirements and can be equipped with a tape applicator for providing adhesive tape.

This invention also provides a method for folding the top of a carton which includes a step of sensing information obtained from a carton, adjusting the flap folding assembly and, then, folding a portion of the carton.

Other objects, features and advantages of the invention will be readily apparent from the following detailed description of preferred embodiments thereof taken in conjunction with the drawings.

BRIEF DESCRIPTION OF THE DRAWINGS

For the purpose of illustrating the invention, there is shown in the accompanying drawings one form which is presently preferred, it being understood that the invention is not intended to be limited to the precise arrangements and instrumentalities shown.

DETAILED DESCRIPTION OF THE INVENTION

Figure 1:
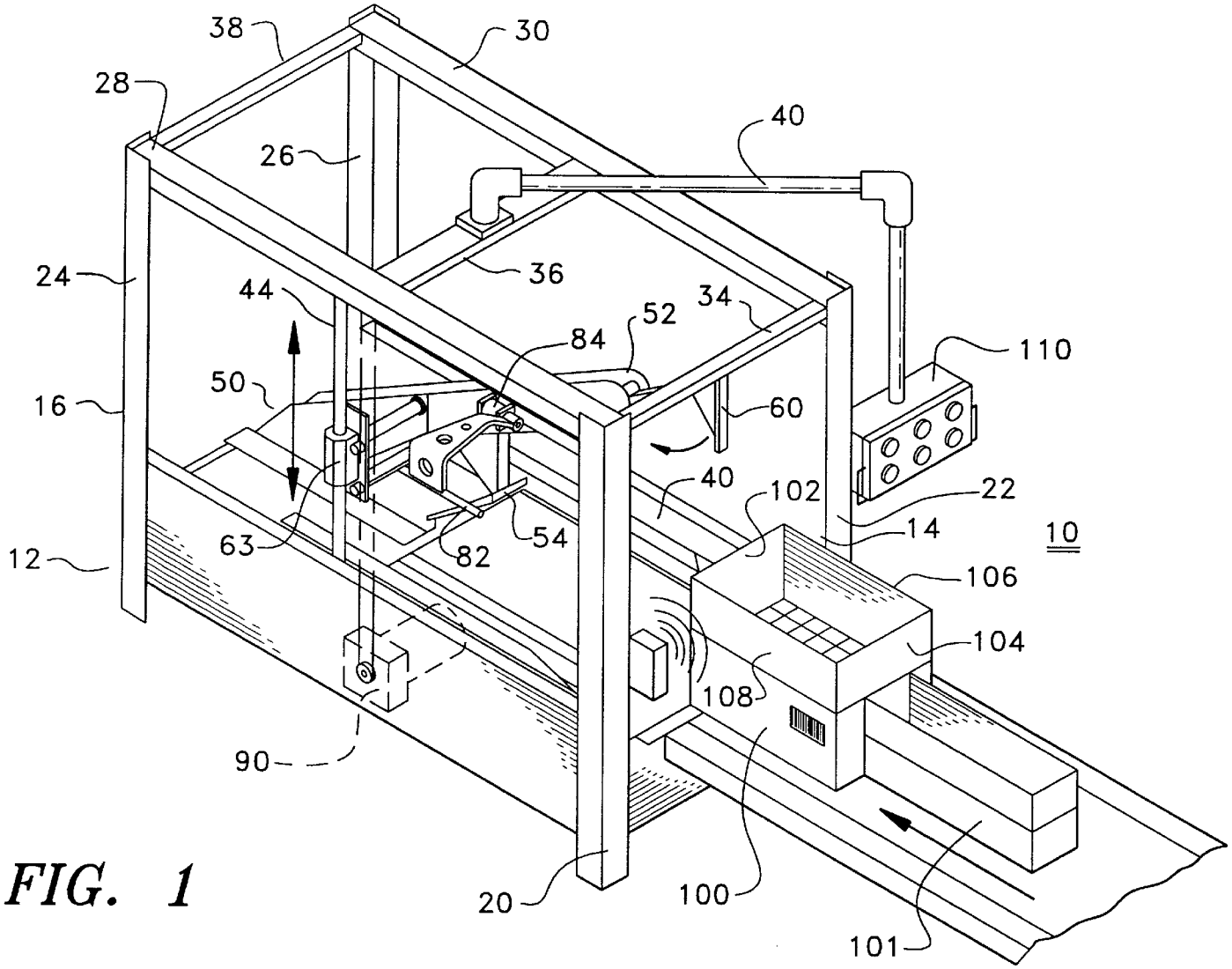
FIG. 1 is a front perspective view of a preferred carton folding apparatus in accordance with the present invention.

Referring now to the drawings in detail wherein like reference numerals have been used throughout the various figures to designate like elements, there is shown in FIG. 1 a carton folding apparatus constructed in accordance with the principles of the present invention and designated generally as 10.

The carton folding apparatus 10 includes a frame 12, preferably comprised of welded iron. The frame has an input end 14 and an output end 16. In the preferred embodiment, the frame 12 includes two opposing front vertical members 20 and 22, two opposing rear vertical members 24 and 26, an upper horizontal member 28, which extends between vertical members 20 and 24, a right horizontal member 30, which extends between vertical members 22 and 26, a front transverse member 34, which extends between the front vertical members 20 and 22, a center transverse member 36, which extends the horizontal members 28 and 30, and a rear transverse member 38, which extends between the vertical members 24 and 26. A conveyor 40 of a type known in the art extends inside the frame between the input end 14 and the output end 16 thereof.

A support rod 44 is installed adjacent one side of the frame 12. A flap folding assembly 50 is mounted for vertical movement along the support rod 44 and is positioned above the conveyor 40 in order to accommodate cartons or boxes of various sizes as more fully described below. The flap folding assembly includes a support member 52, a stationary front flap folding bar 54, right and left outer flap folding members 56 and 58, and a rotatable rear flap folding arm 60 (see FIGS. 1–4). The support member 52 is preferably connected to the support rod 44 by means of an actuator mechanism in the form of a hydraulic cylinder 63. However, other actuator mechanisms such as a pneumatic cylinder could be utilized.

The rear flap folding arm 60 is rotatably mounted to an end of the support member 52. The arm 60 is adapted to swing downwardly upon the triggering of an actuator mechanism associated therewith as more fully described below.

Each of the outer flap folding members 56 and 58 is substantially identical to the other outer flap folding member. Accordingly, only one of the outer flap folding members will be described in detail; it being understood that the description applies equally to the other flap folding member. Outer flap folding member 56 includes a gull wing segment 64. Secured to one end of the gull wing segment 64 is a folding bar 66. The other end of the gull wing segment 64 is rotatably mounted to an actuator mechanism 68 by means of a rotary cylinder 69. The actuator mechanism 68 is preferably a hydraulic cylinder. However, a pneumatic cylinder or other mechanism could be substituted therefor. The actuator mechanism 68 is secured to one side of the support member 52. The gull wing segment 64 preferably includes a curved portion 70 and a substantially planar portion 72 extending from one end of the curved portion. The preferred materials for the gull wing segment is steel, aluminum or polymeric resin, with or without reduced friction coatings, such as PTFE or nylon.

Figure 2:
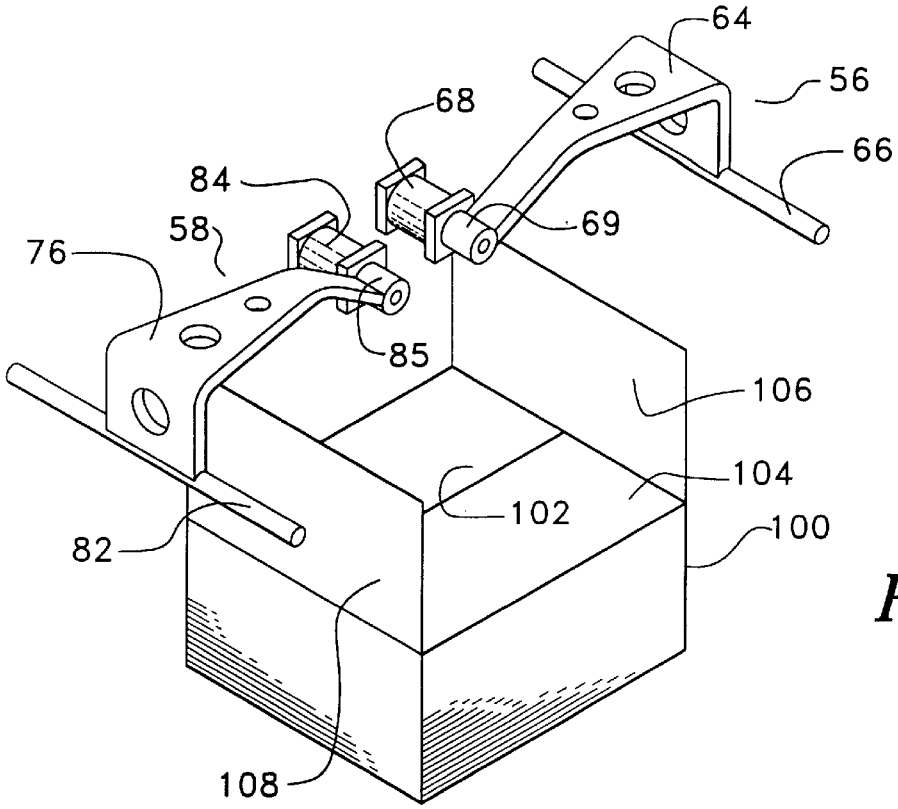
FIG. 2 is a partial front perspective view showing a partially folded box approaching the outer flap folding members.
Figure 3:
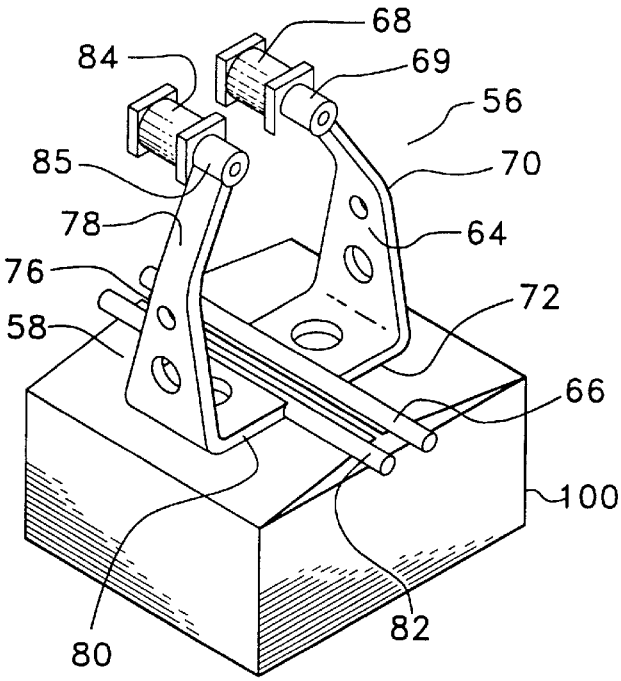
FIG. 3 is a partial front perspective view of the box of FIG. 2 showing the folding of the left and right outer flaps of the box by the gull wing segments.
Figure 4:
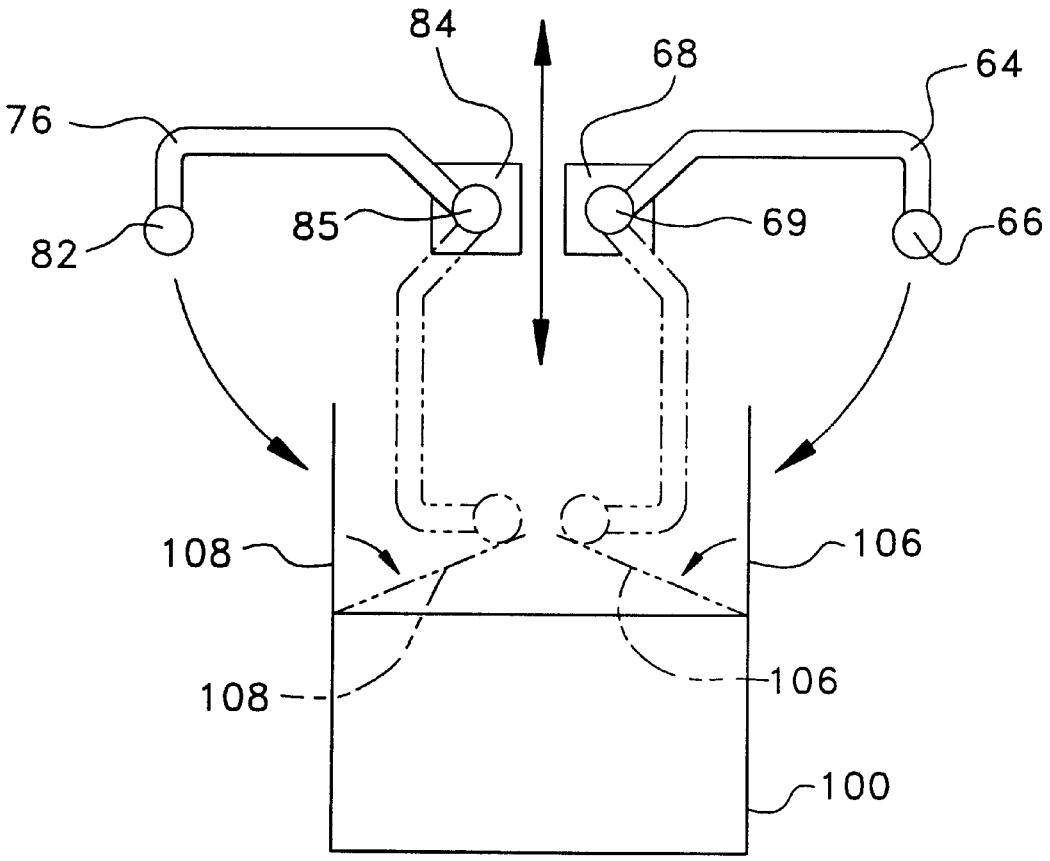
FIG. 4 is a front view of the gull wing segments and box of FIG. 3 showing the closing of the right and left outer flaps.

The outer flap folding member 56 is adapted to be rotated from a first position, wherein the planar portion 72 of the gull wing segment extends at a substantially vertical position (see FIGS. 1, 2 and 4), to a second position, wherein the planar portion 72 extends at a substantially horizontal position (see FIGS. 3 and 4). In the preferred embodiment, the gull wing segment 72 includes a plurality of holes therein to minimize any air resistance as the gull wing segment is moved between the first and second positions.

The outer flap folding member 58 similarly includes a gull wing segment 76, which includes a curved portion 78 and a planar portion 80. One end of the wing element 76 has a folding bar secured thereto and an opposing end rotatably mounted to an actuator mechanism 84 by means of a rotary cylinder 85. The actuator mechanism 84 is secured to the side of the support member 52 opposite the actuator mechanism 68.

In order to facilitate an understanding of the principles associated with the foregoing apparatus, its operation will now be briefly described. Boxes or cartons of various heights and widths, such as shown at 100 and 101 in FIG. 1, are placed in a row on top of the conveyor 40 upstream of the input end 14 of the frame 12. Box 100 includes a front inner flap 102, a rear inner flap 104, a right outer flap 106, and a left outer flap 108, as best illustrated in FIGS. 1 and 2. It should be noted that these flap identities are used as a guide and are dependent on the orientation of the box when it is placed on the conveyor 40. Box 101 is similarly constructed.

The height of the flap folding assembly 50 is vertically adjusted in order to accommodate the dimensions of each box as the conveyor transports the same inside the frame 12 so that the flaps of the box can be properly folded. Further, the distance between the folding bars 66 and 82, when the flap folding members are in the first position, can be increased or decreased depending on the size and dimension of the box. More particularly, if the flaps of a relatively small box were to be folded, the folding bars could be positioned closer to one another thereby causing the planar portions 72 and 80 of the gull wing segments 64 and 76, respectively, to converge toward one another when the flap folding members are in the first position. Each of the actuator mechanisms 63, 68 and 84 can be powered by a servomotor drive 90 or other equivalent means.

In the preferred embodiment, the specific dimensions of each box are automatically sensed by the carton folding apparatus in the manner described in Applicant's pending application, Ser. No. 08/757,894. Briefly, an optical sensor, which preferably includes a bar code reader, a label reader, an infrared position scanner, or the like, senses information about the box 100. This information is sent to a microprocessor located in a control panel shown at 110 in FIG. 1.

The control panel, as described in the aforementioned prior application, can be mounted directly to the frame 12 or can be remotely mounted, on a wall, for example. The microprocessor receives the output signal from the optical scanner and activates the actuator mechanisms 63, via the servomotor drive 90, in order to vertically adjust the height of the flap folding assembly 50 to accommodate the particular size and dimensions of the box 100. The actuator mechanisms 68 and 84 are also activated so that the folding bars 66 and 88 can be brought closer to or further from one another. This is accomplished via the rotation of the gull wing segments to which the folding bars are attached. It should be noted that the height of the flap folding assembly 50 and the distance between the folding bars 66 and 82 can be adjusted in a number of different ways including manually.

Thereafter, the conveyor moves the box 100 downstream passed the input end 14 of the frame 12. As the box is moved downstream, the front inner flap 102 of the box contacts and is folded inwardly by the stationary front flap folding bar 54. The rear inner flap 104 is similarly folded inwardly upon the downward rotation of the rear flap folding arm 60, which is preferably powered by the servomotor 90 upon receipt of a proper signal.

The gull wing segments 64 and 76 are then rotated from the first position (FIGS. 2 and 4) to the second position (FIGS. 3 and 4) upon activation of the cylinders 68 and 84. As the gull wing segments are rotated, folding bar 66, which is secured to gull wing segment 64 contacts the right outer flap 106 and folds the same inwardly. Similarly, folding bar 82, which is secured to gull wing segment 76, contacts the left outer flap 108 of the box 100 and folds the same inwardly. The folded box is then moved further downstream by the conveyor 40 where it is preferably sealed by means known in the art. For example, a tape dispensing mechanism can be provided which is adapted to apply pressure sensitive tape to seal the facing edges of the right and left outer flaps. As the next box 101 approaches the input end 14 of the frame 12, the height and spacing of the gull wing members is once again adjusted to accommodate the specific dimensions of the box 101 in the manner described above.

From the foregoing, it can be realized that this invention provides a more space efficient and more adaptable case folding apparatus and process. The adjustments to the height of the gull wing segments and the spacing between the folding bars are effectuated quite rapidly so that boxes of various sizes can be accommodated without halting the production line. The described machine can accept random or regular sizes of corrugated or cardboard containers from an infeed conveyor at production rates of at least about 18 containers per minute. Box sizes ranging from 10 inches long by 8 inches wide by 8 inches high to about 28 inches long by 20 inches wide by 20 inches high can be readily accommodated with such device. The disclosed apparatus is of a compact design to maximize floor space and reduce processing time.

The present invention may be embodied in other specific forms without departing from the spirit or essential attributes thereof and accordingly reference should be made to the appended claims rather than the foregoing specification as indicating the scope of the invention.

What is claimed is:

1. A carton folding apparatus operable to close the top of a carton having a front inner flap, a rear inner flap, a right outer flap, and a left outer flap, said carton folding apparatus comprising:

a frame having an input end and an output end;

means for transporting said carton from said input end to said output end of said frame; and a flap folding assembly mounted for vertical movement along said frame in order to accommodate cartons of various sizes, said flap folding assembly being positioned above said transporting means, said flap folding assembly including a stationary front flap folding bar, a rotatable rear flap folding arm, a right outer flap folding member, and a left outer flap folding member, each of said outer flap folding members including an end, each of said ends of said outer flap folding members being adapted to be moved closer to or further from one another upon rotation of said outer flap folding members, wherein each of said outer flap folding members contains a plurality of holes therein, the plurality of holes lying in a plane that is orthogonal to a direction of rotation of said outer flap members.

2. The carton folding apparatus of claim 1 wherein each of said outer folding members includes a curved portion and a substantially planar portion.

3. The carton folding apparatus of claim 2 wherein each of said planar portions of said outer folding members has a folding bar secured thereto.

4. The carton folding apparatus of claim 1 further including means for automatically adjusting the vertical distance between said flap folding assembly and said transporting means in order to accommodate cartons of different sizes without substantially interrupting a production line.

5. The carton folding apparatus of claim 4 wherein said automatically adjusting means includes:

sensor means mounted to said frame for obtaining information concerning the dimensions of said carton, said sensor means producing an electrical output signal relating to the dimensions of said carton, said vertically adjusting means vertically moving said flap folding assembly in response to said electrical output signal.

6. The carton folding apparatus of claim 5 wherein said sensor means comprises an optical sensor.

7. The carton folding apparatus of claim 6 wherein said sensor is a label reader, a bar code reader, or an infrared position scanner.

8. The carton folding apparatus of claim 1 further including:

a support rod mounted adjacent one side of said frame;

a cylindrical actuating mechanism mounted for vertical movement along said support rod, and means for attaching said flap folding assembly to said cylindrical actuating mechanism.

9. The carton folding apparatus of claim 8 wherein said cylindrical actuating mechanism includes a hydraulic cylinder.

10. A method of closing the top of a carton having a front inner flap, a rear inner flap, a right outer flap, and a left outer flap, said method comprising the steps of:

providing a carton folding apparatus, said carton folding apparatus including a frame, a conveyor means and a flap folding assembly including outer flap folding members having ends, wherein each of said outer flap folding members contains a plurality of holes therein, the plurality of holes lying in a plane that is orthogonal to a direction of rotation of said outer flap members;

placing a carton on said conveyor means upstream of said flap folding assembly;

vertically adjusting said flap folding assembly to accommodate the specific dimensions of said carton;

conveying said carton downstream to a position adjacent said flap folding assembly, activating said flap folding assembly to fold said front inner flap, rear inner flap, right outer flap and left inner flap inwardly in order to close said carton, including:

rotating said outer flap folding members, and moving each of said ends of said outer flap folding members closer to or further from one another upon rotation of said outer flap folding members.

11. The method of claim 10 further including the step of sealing said carton with an adhesive tape after said flaps are folded inwardly.

12. The method of claim 10 further comprising the steps of:

providing sensing means upstream of said flap folding assembly to obtain information regarding the dimensions of said carton;

automatically adjusting the height of said flap folding assembly in response to said sensed information in order to accommodate cartons of various sizes.

13. The method of claim 10 wherein said flap folding assembly is adjusted without interrupting the movement of said carton by said conveyor means.

14. The method of claim 10 wherein said flap folding assembly includes a stationary front flap folding bar, a rotatable rear flap folding arm, a right outer flap folding member, and a left outer flap folding member, each of said outer flap folding members including a free end, and wherein said method further comprises the step of:

rotating said outer flap folding members in order to move each of said ends thereof closer to or further from one another before said conveyor transports said carton adjacent said flap folding assembly.

* * * * *